US007633737B2

(12) United States Patent
Ramarge et al.

(10) Patent No.: US 7,633,737 B2
(45) Date of Patent: Dec. 15, 2009

(54) LIQUID IMMERSED SURGE ARRESTER

(75) Inventors: Michael M. Ramarge, Olean, NY (US); Alan P. Yerges, Muskego, WI (US)

(73) Assignee: Cooper Technologies Company, Houston, TX (US)

( * ) Notice: Subject to any disclaimer, the term of this patent is extended or adjusted under 35 U.S.C. 154(b) by 164 days.

(21) Appl. No.: 10/834,388

(22) Filed: Apr. 29, 2004

(65) Prior Publication Data

US 2005/0243495 A1 Nov. 3, 2005

(51) Int. Cl.
*H02H 1/00* (2006.01)
*H01C 7/12* (2006.01)
*H02H 7/04* (2006.01)

(52) U.S. Cl. ..... 361/117; 361/118; 361/35; 361/36; 361/39

(58) Field of Classification Search ..... 361/117, 361/118, 35, 38, 39, 36
See application file for complete search history.

(56) References Cited

U.S. PATENT DOCUMENTS 2,971,132 A * 2/1961 Nash ..... 361/124
3,102,178 A * 8/1963 Bronikowski ..... 337/223
3,913,127 A 10/1975 Suzuki et al.
4,272,411 A 6/1981 Sokoly et al.
4,282,557 A 8/1981 Stetson
4,296,002 A 10/1981 Sokoly et al.
4,352,140 A 9/1982 Axelsson et al.
4,388,603 A 6/1983 Hassler et al.
4,404,614 A 9/1983 Koch et al.
4,444,351 A 4/1984 Dries et al.
4,456,942 A 6/1984 Bronikowski
4,656,555 A 4/1987 Raudabaugh
4,729,053 A 3/1988 Maier et al.
4,780,598 A 10/1988 Fahey et al.
4,825,188 A 4/1989 Parraud et al.
4,833,438 A 5/1989 Parraud et al.
4,851,955 A 7/1989 Doone et al.

(Continued)

FOREIGN PATENT DOCUMENTS

DE 3 334 533 4/1985

(Continued)

OTHER PUBLICATIONS

International Search Report mailed Oct. 17, 2005 in PCT Application No. PCT/US2005/014590.

*Primary Examiner*—Rexford Barnie
*Assistant Examiner*—Lucy Thomas
(74) *Attorney, Agent, or Firm*—Fish & Richardson P.C.

(57) ABSTRACT

A liquid immersed surge arrester that protects electrical equipment includes a module assembly. The module assembly includes at least one varistor and a pre-impregnated composite around the at least one varistor. The liquid immersed surge arrester also includes contacts on opposite ends of the module assembly with which the module assembly is connected to electrical equipment to be protected and to electrical ground. The liquid immersed surge arrester also includes a tank that houses the module assembly and the contacts.

A fault-tolerant protection device for protecting electrical equipment includes a surge arrester to protect electrical equipment from damage during periods of voltage above a normal operating range. The fault-tolerant protection device also includes a surge durable fuse element to disconnect the surge arrester after failure of the surge arrester to allow unprotected operation of the electrical system.

44 Claims, 4 Drawing Sheets

U.S. PATENT DOCUMENTS

| | | | |
|---|---|---|---|
| 4,899,248 | A | 2/1990 | Raudabaugh |
| 4,962,440 | A | 10/1990 | Johnnerfelt et al. |
| 4,992,906 | A | 2/1991 | Doone et al. |
| 5,003,689 | A | 4/1991 | Doone et al. |
| 5,008,646 | A | 4/1991 | Hennings et al. |
| 5,043,838 | A | 8/1991 | Sakich |
| 5,047,891 | A | 9/1991 | Nedriga |
| 5,128,824 | A | 7/1992 | Yaworski et al. |
| 5,159,748 | A | 11/1992 | Doone et al. |
| 5,218,508 | A | 6/1993 | Doone |
| 5,220,480 | A | 6/1993 | Kershaw, Jr. et al. |
| 5,225,265 | A | 7/1993 | Prandy et al. |
| 5,237,482 | A | 8/1993 | Osterhout et al. |
| 5,291,366 | A | 3/1994 | Giese et al. |
| 5,313,184 | A | 5/1994 | Greuter et al. |
| 5,363,266 | A | 11/1994 | Wiseman et al. |
| 5,497,138 | A | 3/1996 | Malpiece et al. |
| 5,570,264 | A | 10/1996 | Lundquist et al. |
| 5,602,710 | A | 2/1997 | Schmidt et al. |
| 5,608,597 | A | 3/1997 | Holmström et al. |
| 5,652,690 | A | 7/1997 | Mansfield et al. |
| 5,912,611 | A | 6/1999 | Berggren et al. |
| 5,923,518 | A | 7/1999 | Hensley |
| 5,926,356 | A | 7/1999 | Sakich et al. |
| 5,930,102 | A | 7/1999 | Rook |
| 5,936,826 | A | 8/1999 | Schmidt |
| 5,959,822 | A | 9/1999 | Bock et al. |
| 5,990,778 | A | 11/1999 | Strümpler et al. |
| 6,008,975 | A | 12/1999 | Kester et al. |
| 6,008,977 | A | 12/1999 | Thatcher |
| 6,185,813 | B1 | 2/2001 | Donnola |
| 6,279,811 | B1 | 8/2001 | Ramarge et al. |
| 6,396,676 | B1 | 5/2002 | Doone et al. |
| 2003/0043526 | A1 * | 3/2003 | Ramarge et al. ..... 361/117 |

FOREIGN PATENT DOCUMENTS

| | | | |
|---|---|---|---|
| EP | 0 595 376 | A2 | 5/1994 |
| EP | 0 642 141 | | 3/1995 |
| GB | 2 114 388 | A | 8/1983 |
| JP | 03-034522 | | 2/1991 |
| JP | 11-340635 | | 12/1999 |
| WO | WO 99/08353 | | 2/1999 |
| WO | WO 99/18642 | | 4/1999 |

* cited by examiner

LIQUID IMMERSED SURGE ARRESTER

TECHNICAL FIELD

This description relates to liquid immersed surge arresters.

BACKGROUND

A surge arrester is used to protect relatively expensive electrical equipment from damage during periods of over-voltage in which the voltage to which the electrical equipment is exposed is higher than a normal operating range. The surge arrester diverts current around the electrical equipment to ground during periods of over-voltage, thereby shielding the electrical equipment from the high voltages and corresponding currents. Prolonged exposure to abnormally high voltages may cause the surge arrester to fail in a short-circuited state.

If no mechanism is provided for disconnecting the failed arrester from the circuit, the arrester is said to have failed closed. After failing closed, the surge arrester prevents current from flowing to the electrical equipment even after the period of over-voltage, which prevents normal operation of the electrical equipment. If a mechanism is provided for disconnecting the failed arrester from the circuit, the arrester is said to have failed open, in which case the electrical equipment may operate normally. However, the electrical equipment that was protected by the surge arrester that has failed open is no longer protected by the surge arrester.

Conventional surge arresters include one or more metal oxide varistor (MOV) disks that are held in compression within a fiberglass filament wound tube between a fixed snap-ring electrode and a removable spider spring assembly. Current flows through the electrode and the MOV disks during periods of over voltage and when the surge arrester has failed closed. The spider spring assembly is a mechanical device that is expelled out of the end of the tube in the event of arrester failure. The spring force on the MOV disks is consequently released, and the electrode and the MOV disks drop out of the tube, thereby breaking the electrical pathway through the surge arrester and permitting current to flow to the electrical equipment. In some cases, the tube may be projected upward in response to the release of the spring force. Machining required to create venting slots through the side wall of the tube and to cut grooves into the tube to accept the electrode and spider spring assembly may be expensive.

To enable the venting of gases generated within the filament wound tube, pre-formed weaknesses may be created in the side wall of the tube. Pre-formed weaknesses are areas of the tube where the side wall is thinner than usual. When the pressure of the gases within the tube exceeds a maximum pressure that may be withstood by the pre-formed weaknesses, the planned weaknesses break to provide paths through which the gases may be vented. Pre-formed weaknesses are necessary because the walls of the tube are otherwise too thick, and the pressure required to break through the walls is too great. Machining the pre-formed weaknesses into the filament wound tube may be expensive.

SUMMARY

In one general aspect, a liquid immersed surge arrester that protects electrical equipment includes a module assembly. The module assembly includes at least one varistor and a pre-impregnated composite around the at least one varistor. The liquid immersed surge arrester also includes contacts on opposite ends of the module assembly with which the module assembly is connected to electrical equipment to be protected and to electrical ground. The liquid immersed surge arrester also includes a tank that houses the module assembly and the contacts.

Implementations may include one or more of the following features. For example, the liquid immersed surge arrester may include insulating fluid that fills the tank. The insulating fluid may be a mineral oil or a vegetable based oil. The electrical equipment may be a transformer.

The pre-impregnated composite may include a fabricated matrix of fiber bundles impregnated with epoxy resin and arranged around the at least one varistor, with the epoxy resin occupying any open spaces in the fabricated matrix of fiber bundles. The fiber bundles may be of a uniform or non-uniform length. The fiber bundles may be oriented in a predetermined or random orientation. The fiber bundles may include fiberglass or a non-conductive material.

The pre-impregnated composite may be at least 50% epoxy resin by weight. The pre-impregnated composite may be applied circumferentially or vertically to the at least one varistor. The pre-impregnated composite may be applied around the at least one varistor multiple times. The pre-impregnated composite may be applied both circumferentially and vertically around the at least one varistor. The pre-impregnated composite may have a predetermined thickness.

The liquid immersed surge arrester may include a surge durable fuse element connected to the module assembly and operable to disconnect the module assembly after the module assembly has failed. The surge durable fuse element may be a wire that melts and separates after exposure to sufficient power frequency current for a sufficient period of time. The liquid immersed surge arrester may include a support for the surge durable fuse element. The support may include arc-shortening tabs.

In another general aspect, a fault-tolerant protection device for protecting electrical equipment includes a surge arrester to protect electrical equipment from damage during periods of voltage above a normal operating range. The fault-tolerant protection device also includes a surge durable fuse element to disconnect the surge arrester after failure of the surge arrester to allow unprotected operation of the electrical system.

Implementations may include one or more of the following features. For example, the surge durable fuse element may disconnect the surge arrester after failure of the surge arrester by preventing electric current from flowing through the surge arrester and thereby permitting current to flow through the electrical system.

The surge arrester and the surge durable fuse element may be connected in series with ground. The series combination of the surge durable fuse element and the surge arrester may be connected in parallel with electrical equipment. The surge durable fuse element may disconnect the surge arrester after failure of the surge arrester by breaking the series connection between the surge arrester and ground. The surge durable fuse element may break the series connection between the surge arrester and ground by melting the surge durable fuse element.

The surge arrester may protect the electrical equipment from damage during periods of voltage above the normal operating range by diverting current through the surge arrester and away from the electrical equipment during the period of voltage above the normal operating range.

The surge durable fuse element may be a wire that melts and separates after exposure to a sufficient power frequency current for a sufficient period of time. The surge arrester may include one or more metal oxide varistor disks. The fault-tolerant protection device may include a support for the surge durable fuse element. The support may include arc-shortening tabs.

In another general aspect, a fault-tolerant protection device for protecting electrical equipment includes a surge arrester connected in parallel to electrical equipment that has an impedance higher than an impedance of the electrical equipment at normal operating voltages and an impedance lower than an impedance of the electrical equipment at abnormally high voltages. The fault tolerant protection device also includes a surge durable fuse element connected in series with the surge arrester. The surge durable fuse element is configured to melt and separate when exposed to excessive power frequency current flowing through the surge arrester.

Implementations may include one or more of the following features. For example, the surge arrester may be connected in series with the surge durable fuse element. The series combination of the surge arrester and the surge durable fuse element may be connected in parallel with the electrical equipment.

The surge arrester may include a module assembly that has an impedance higher than an impedance of the electrical equipment at normal operating voltages and an impedance lower than an impedance of the electrical equipment at abnormally high voltages. The module assembly may include one or more metal oxide varistor disks, one or more spark gap assemblies, or one or more electrically conductive spacer elements.

The electrical equipment may be a transformer. The surge arrester and the surge durable fuse element may be internally incorporated in the electrical equipment. The electrical equipment may be filled with an insulating fluid. The insulating fluid may be a mineral oil or a vegetable based oil.

The fault-tolerant protection device may include a support for the surge durable fuse element. The support may include arc-shortening tabs.

The details of one or more implementations are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

Figure 1:
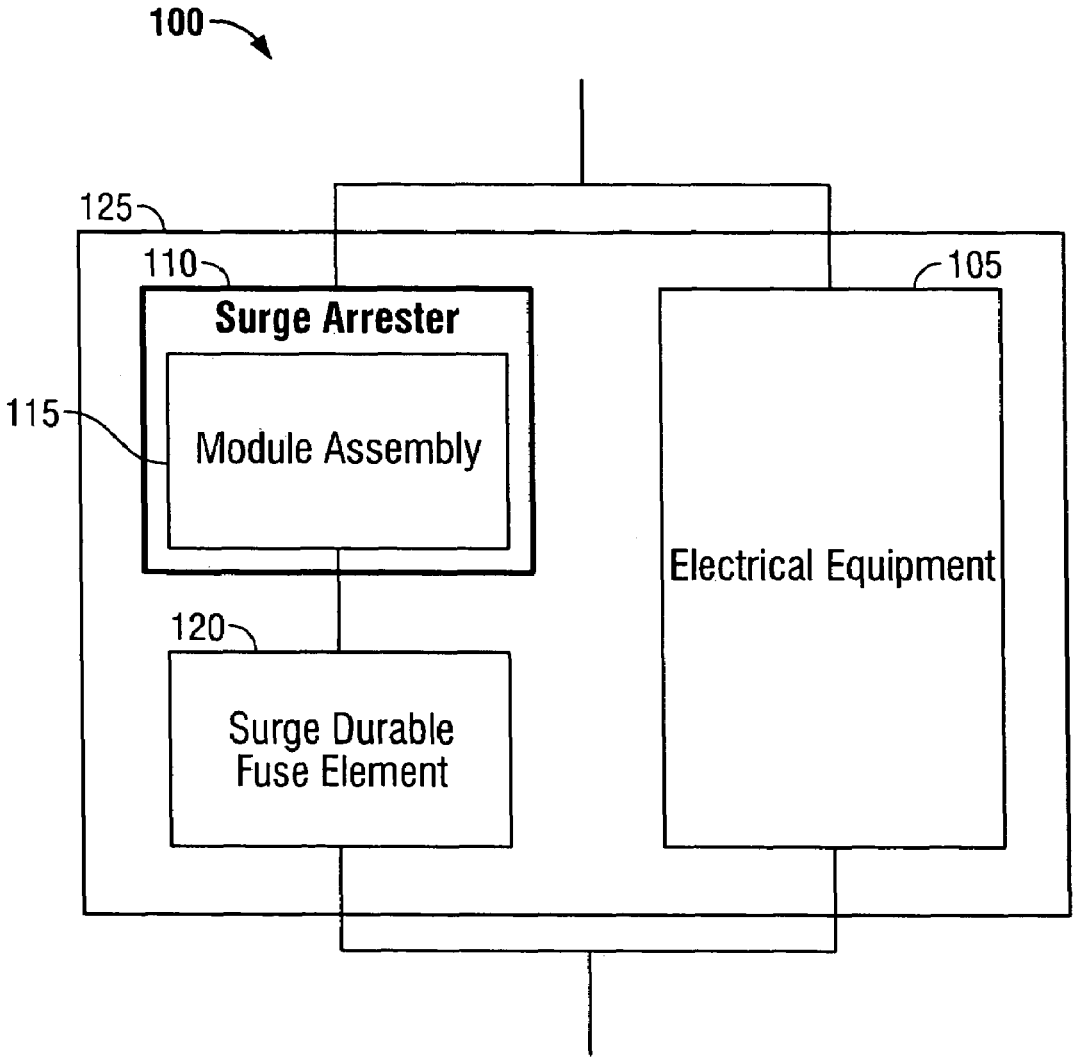
FIG. 1 is a block diagram of an electrical system in which electrical equipment is protected by a surge arrester.

A liquid immersed surge arrester that diverts excess current away from electrical equipment protected by the surge arrester includes a module assembly wrapped in a pre-impregnated composite. The module assembly includes one or more varistors, which are non-linear resistive elements. During failure of the surge arrester, the pre-impregnated composite enables venting of gases that have built up within the module assembly. The pressure of the gases forces one or more holes through the resin of the pre-impregnated composite. The gases may be vented through the holes to relieve the pressure within the module assembly. Pre-formed weaknesses in the pre-impregnated composite are not necessary to enable venting of the gases.

The pre-impregnated composite ensures that the module assembly is a solid dielectric without air voids and is impervious to moisture ingress. A surge arrester constructed using the described techniques fails in a desired, non-fragmenting manner such that all major parts of the arrester are retained by venting through the pre-impregnated composite. The pre-impregnated composite provides the surge arrester with the sufficient electrical insulation to withstand periods of voltage above a normal operating range while using a relatively small amount of material, which reduces the size of the surge arrester. Furthermore, use of the pre-impregnated composite reduces the number of components of the surge arrester, which simplifies the assembly of the surge arrester, and thereby reduces the costs associated with producing the surge arrester.

The surge arrester may be coupled to a surge durable fuse element that disconnects the surge arrester from the protected electrical equipment in the event of surge arrester failure. The surge durable fuse element melts and breaks after prolonged exposure to power frequency current. The surge durable fuse element is part of a pathway through the surge arrester to ground through which current flows during periods of overvoltage and after the surge arrester has failed in a state where all current flows through the surge arrester to ground and not through the electrical equipment. When the surge durable fuse element is broken, the pathway through the surge arrester to ground is interrupted, which forces all current to flow through the electrical equipment that is protected by the surge arrester. This allows the electrical equipment to operate after the surge arrester has failed but also exposes the electrical equipment to damage from subsequent periods of over-voltage. The surge arrester, the surge durable fuse element, and the electrical equipment may be placed in a tank, and the tank may be filled with an insulating fluid.

The surge durable fuse element and the pre-impregnated composite reduce the impact of an arrester failure while providing for isolation of the surge arrester in the event of such a failure and allowing the electrical equipment to operate after the surge arrester has failed. The arc formed between the broken ends of the surge durable fuse element is much shorter and controlled than the arcs of conventional surge arresters due to the reduced distance traveled by the arc. As a result, less arc energy is produced, which reduces the likelihood of damage to the electrical equipment to which the surge arrester is connected. Use of the surge durable fuse element reduces or eliminates potentially destructive motion in the components of the surge arrester when breaking the current pathway through the surge arrester. Without motion, the clearance required around the components of the surge arrester is reduced, and the mechanical strength of the surge arrester is maintained. Lead wire location also is maintained, which eliminates the potential for interference with other components of the surge arrester or the electrical equipment.

Use of the surge durable fuse element and the pre-impregnated composite also creates a cost reduction over conventional surge arresters due to the reduction in the number of components in the surge arrester, the simplicity of the electrodes required, and the elimination of the expensive filament wound tube found in conventional surge arresters. Assembly of the surge arrester also is simplified over conventional surge arresters through use of the surge durable fuse element and the pre-impregnated composite.

Figure 2:
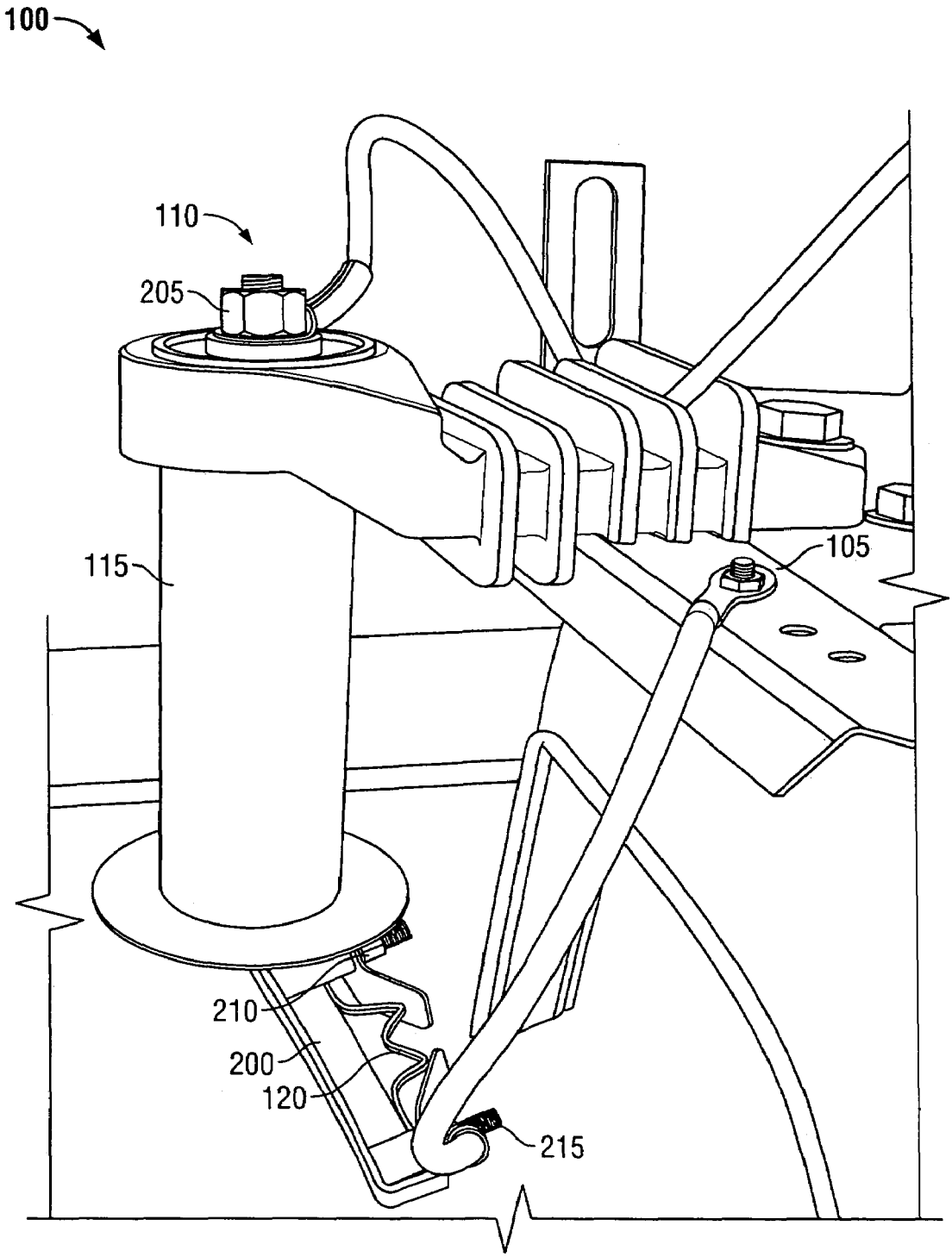
FIG. 2 is an illustration of one implementation of the electrical system of FIG 1.

FIGS. 1 and 2, show an electrical system 100 in which electrical equipment 105 is protected by a surge arrester 110.

More particularly, the surge arrester 110 includes a module assembly 115 that directs current to or away from the electrical equipment 105 based on the voltage to which the module assembly 115 is exposed. The surge arrester 110 is connected in parallel with the electrical equipment 105. In some implementations, the surge arrester 110 is connected in series with a surge durable fuse element 120, and the series connection of the surge arrester 110 and the surge durable fuse element 120 is connected in parallel with the electrical equipment 105. The surge durable fuse element 120 breaks the parallel connection with the electrical equipment 105 when the surge arrester 110 has failed, which permits normal operation of the electrical equipment 105 after failure of the surge arrester 110. The electrical equipment 105, the surge arrester 110, and the surge durable fuse element 120 are connected at contacts 205, 210 and 215.

In some implementations, the electrical system 105 may be a transformer that converts a voltage on an input to the transformer to a corresponding voltage on an output of the transformer. For example, the transformer may be a pad-mount transformer. In such implementations, the electrical system 100 may be placed inside a fluid filled tank 125. After the transformer, the surge arrester 110, and the surge durable fuse element 120 have been placed inside the tank 125, the tank 125 is filled with an electrical insulating and heat conducting fluid and then sealed. The fluid may be a gas, such as SF6, or a liquid, such as a transformer insulating oil, a fire resistant insulating fluid (e.g., silicone), a commercially available fluid (e.g., R-temp™), a seed-based, high-fire-point dielectric fluid (e.g., FR-3™), a mineral oil, or a vegetable-based oil. Connections may be made to the electrical system 100 through holes in the front of the tank 125. More particularly, a suitable, commercially-available electrical bushing may be used to form external connections from the tank 125.

The surge arrester 110 is a protective device that commonly is connected in parallel with comparatively expensive electrical equipment 105 so as to shunt or divert over-voltage-induced current surges safely around the electrical equipment 105, and thereby protect the equipment 105 and its internal circuitry from damage. The module assembly 115 within the surge arrester 110 causes current to flow through the surge arrester 110 during periods of over-voltage. The module assembly 115 operates in a low-impedance mode that provides a current path to electrical ground having a relatively low impedance when exposed to an over-voltage condition. The module assembly 115 otherwise operates in a high impedance mode that provides a current path to ground having a relatively high impedance. When the surge arrester 110 is operating in the low impedance mode, the impedance of the current path to ground is substantially lower than the impedance of the electrical equipment 105 being protected by the surge arrester 110. As a result, current flows through the current path to ground. The impedance otherwise is substantially higher than the impedance of the protected equipment 105, such that current flows through the electrical equipment 105. Upon completion of the over-voltage condition, the surge arrester 110 returns to operation in the high-impedance mode, which prevents normal power frequency current from following the surge current to ground along the current path through the surge arrester 110.

The module assembly 115 typically includes a stack of one or more voltage-dependent, nonlinear resistive elements that are referred to as varistors. An example of a varistor is a MOV disk. A varistor is characterized by having a relatively high resistance when exposed to a normal operating voltage, and a much lower resistance when exposed to a larger voltage, such as is associated with over-voltage conditions. In addition to or in place of varistors, the module assembly 115 also may include one or more spark gap assemblies electrically connected in series with the varistors. Some module assemblies 115 also include one or more electrically conductive spacer elements coaxially aligned with the varistors and gap assemblies. The varistors provide the module assembly 115 with the characteristic non-linear impedances that allow the module assembly 115 to cause current to flow through the surge arrester 110 during periods of over-voltage and through the electrical equipment 105 otherwise.

In some implementations, the varistors in the module assembly 115 are reinforced with a pre-impregnated composite. The pre-impregnated composite may be any woven or interwoven fabric, sheet, tape or strip. The pre-impregnated composite may take other forms, such as, for example, a collection of fiber segments. The pre-impregnated composite may encompass any form factor, and may be narrow or wide as needed to selectively reinforce the varistors. The pre-impregnated composite typically has a pre-formed woven or interwoven pattern with fibers oriented in a set orientation. Implementations include fibers oriented to be parallel, perpendicular or at any other angle with respect to an axis of the stack. Other implementations include fibers that are randomly oriented.

The length of the fibers in the pre-impregnated composite may be predetermined or random. Implementations include fibers that are, for example, continuous, of at least one predetermined length, or random in length. The fibers of the pre-impregnated composite typically are pre-impregnated with resin. The matrix may be, for example, dipped, cast, powder cast, or otherwise pre-impregnated. The fibers may be any insulating, non-conducting fibrous material such as, for example, fiberglass, Kevlar, or Nextel.

The pre-impregnated composite may be applied circumferentially or vertically around the varistors of the module assembly 115. In some implementations, multiple layers of the pre-impregnated composite may be applied around the varistors. Some of the multiple layers may be applied circumferentially, and some of the layers may be applied vertically. Shrink film then may be applied to the module assembly 115 to aid in compacting the pre-impregnated composite structure. In one implementation, the shrink film is a bi-axially oriented polypropylene film. When heated, the shrink film shrinks and applies a compressive force to the module assembly 115. The shrink film is attached substantially at one end of the module assembly 115, spiral wound around the length of the module assembly 115, and attached to the opposite end of the module assembly 115.

After the shrink film has been applied to the entire module assembly 115, the module assembly 115 is heated to a first temperature range that makes the epoxy resin of the pre-impregnated composite structure viscous, and causes the shrink film to shrink and compact the viscous pre-impregnated composite structure. The module assembly 115 then is heated to a second temperature range for curing that is greater than the first temperature range. The second temperature range is high enough that the shrink film relaxes and does not apply a compressive force to the module assembly 115 as the module assembly 115 is cured. After curing, the shrink film is removed from the module assembly 115, and the module assembly 115 is included in the surge arrester 110.

When a surge arrester fails, ionized gases are generated by the power arc within the module assembly 115. As the amount of ionized gas increases within the module assembly 115, the pressure of the gas correspondingly increases. The pressure increases until the pressure is great enough to fracture the epoxy resin of the pre-impregnated composite that reinforces the module assembly 115. When the epoxy resin has been fractured, the ionized gases that have collected within the module assembly 115 may escape from the module assembly 115 through the fracture in the resin. As a result of venting of the ionized gases, the pressure within the module assembly 115 decreases rapidly as the power arc is transferred outside of the module assembly 115, thereby preventing explosion of the module assembly 115. After venting, the surge arrester 110 is left in a non-operable state.

The venting of the surge arrester 110 and of the module assembly 115 in such a manner during failure may prevent the electrical equipment 105 being protected by the surge arrester 110 from being damaged. If the gas within the module assembly 115 is not vented in the desired manner, the pressure of the gas increases until the module assembly 115 did not have enough mechanical strength to withstand the pressure. In such a case, the module assembly 115 could fail catastrophically, potentially expelling parts that could damage the electrical equipment 105 being protected by the surge arrester 110. For example, leads of the surge arrester 110 do not move when the surge arrester 110 fails, which prevents the leads from arcing to the tank or falling into the electrical equipment 105. Since the module assembly 115 does not move, clearance around the module assembly 115 is not necessary. In addition, pre-formed weaknesses need not be included in the pre-impregnated composite to enable venting of the gases.

The surge arrester 110 may be implemented as any class of surge arrester, including a station class surge arrester, an intermediate class surge arrester, and a distribution class surge arrester. After prolonged exposure to voltages above a normal operating range, the surge arrester 110 may fail in a state where current always flows through the surge arrester 110 to ground and not through the electrical equipment. In other words, the surge arrester 110 may fail in short-circuited condition commonly referred to as failing closed. When the surge arrester 110 has failed closed, the impedance of the module assembly 115 is lower than the impedance of the electrical equipment 105, such that current flows through the surge arrester 110, regardless of the voltage in the electrical system 100.

Figure 3:
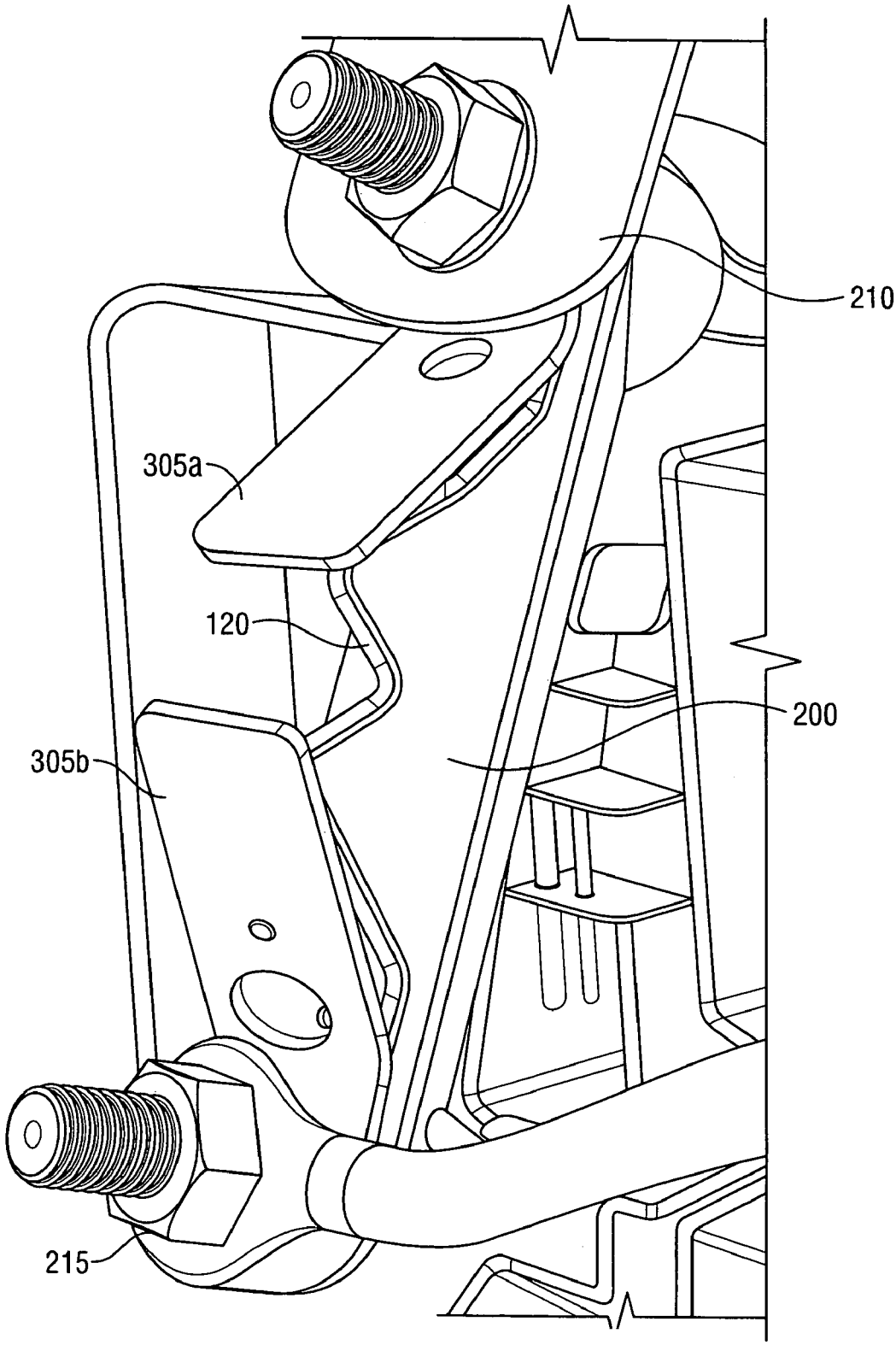
FIG. 3 is an illustration of a surge durable fuse element used in the electrical system of FIG. 1.

Referring also to FIG. 3, the electrical system 100 may include a surge durable fuse element 120 connected in series with the surge arrester 110. The surge durable fuse element 120 is a piece of wire that melts and separates after prolonged exposure to power frequency current so as to break the connection through the surge arrester 110 to ground. In some implementations, the surge durable fuse element 120 is curved to reduce the size of the surge durable fuse element 120. An example of the surge durable fuse element 120 is an isolation link.

The surge durable fuse element 120 is supported by a support 200 that extends around the surge durable fuse element 120. The support is capable of withstanding the high temperatures associated with melting and separation of the surge durable fuse element 120. The support 200 may include arc-shortening tabs 305*a* and 305*b* that shorten the length of the arc formed between the separated ends of the surge durable fuse element 120, which decreases the amount of energy released. Furthermore, the shorter arc results in a decreased gas pressure within the tank in which the surge arrester 110 has been placed.

The surge durable fuse element 120 is exposed to excessive power frequency current when the surge arrester 110 has failed. When the surge durable fuse element 120 has separated, the parallel connection between the surge arrester 110 and the electrical equipment 105 is broken, which results in the surge arrester being disconnected. In other words, the surge durable fuse element 120 enables the surge arrester to fail open. Consequently, the only electrical path through the electrical system 100 is through the electrical equipment 105. Current then flows through the electrical equipment 105, and normal operation of the electrical equipment 105 occurs. However, after the surge durable fuse element 120 is melted, the electrical equipment 105 is not protected by the surge arrester 110 and is exposed to the risk of damage from subsequent periods of unusually high voltage.

In general, the time required to melt the surge durable fuse element 120 is inversely proportional to the amount of power frequency current to which the surge durable fuse element is exposed. In one implementation, the surge durable fuse element 120 melts after approximately one cycle (approximately 16.67 ms) of exposure to an approximately 1250 A power frequency current.

Referring again to FIGS. 1 and 2, the electrical equipment 105, the surge arrester 110, and the surge durable fuse element 120 are connected at contacts 205, 210 and 215. More particularly, the contact 205 connects the top of the surge arrester 110 to the electrical equipment 105, the contact 210 connects the bottom of the surge arrester 110 to one end of the surge durable fuse element 120, and the contact 215 connects the opposite end of the surge durable fuse element 120 to the end of the electrical equipment 105 not connected to the surge arrester 110.

Figure 4:
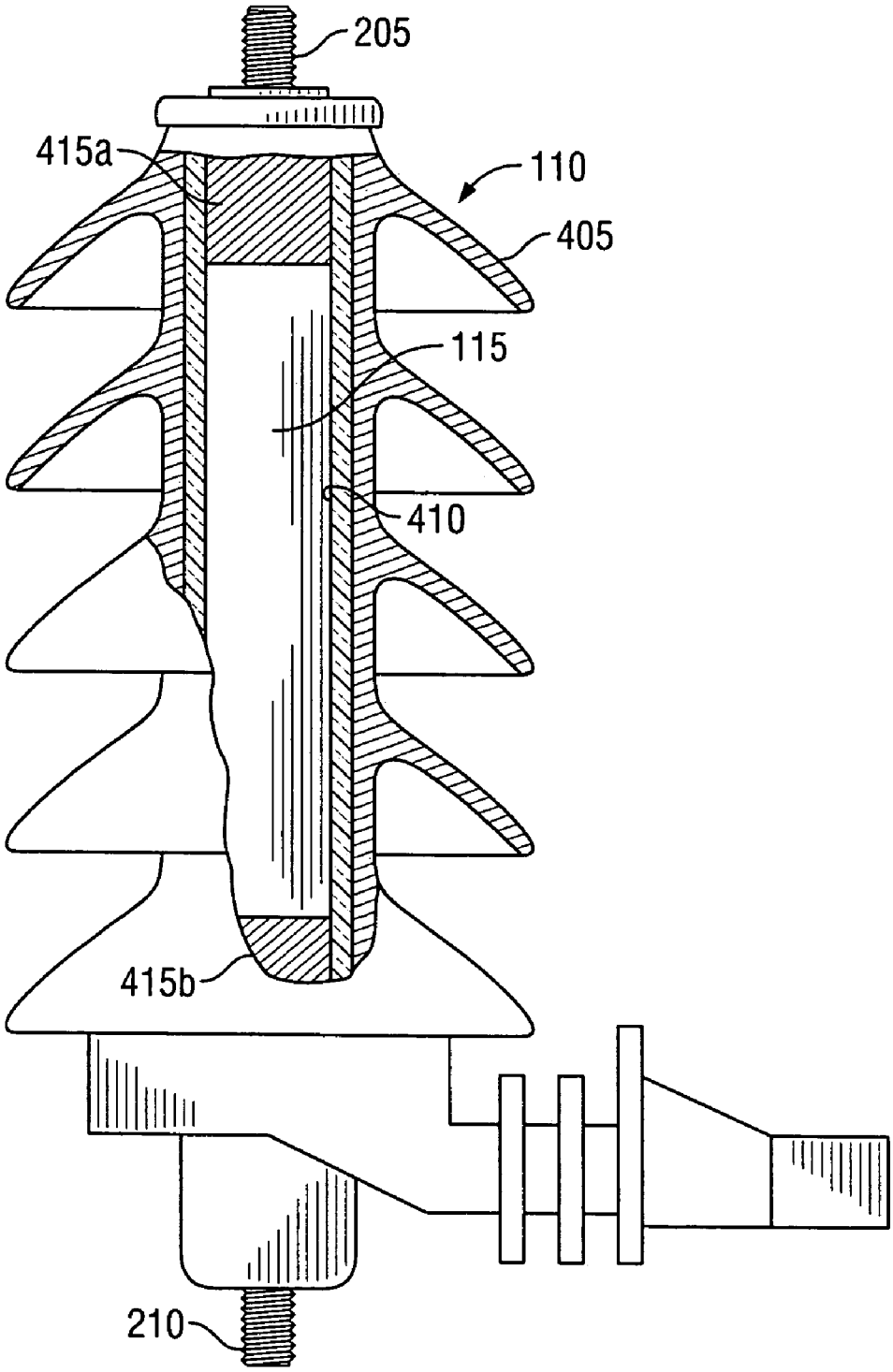
FIG. 4 is an illustration of one implementation of the surge arrester of FIG. 1.

In some implementations, the surge durable fuse element 120 also may be used in conjunction with a surge arrester 110 and electrical equipment 105 that are not liquid immersed in a tank. For example, the surge durable fuse element 120 may be used with surge arresters in overhead applications, such as on utility poles. Referring also to FIG. 4, in such implementations, the surge arrester may include a housing 405 in which the module assembly 115 is located. The housing 405 protects the surge arrester 110 from environmental conditions of the overhead applications and may be made of an electrically insulating polymeric, ceramic, or porcelain material. In some implementations, the surge durable fuse element 120 also may be placed inside the housing 405 for protection.

The contact 205 may be disposed in an upper terminal near the top of the housing 405. Similarly, the contact 210 may be disposed in a lower terminal near the bottom of the housing 405. The upper terminal and the lower terminal may connect to the module assembly 115 to provide a series electrical path through the surge arrester 110 from the contact 205 to ground at the contact 210. The surge arrester 110 also may be connected to electrical equipment protected by the surge arrester 110 at the contacts 205 and 210. More particularly, one end of the electrical equipment may be connected to the surge arrester at the contact 205, and an opposite end of the electrical equipment may be connected to the surge arrester 110 at the contact 210.

Melting the surge durable fuse element 120 is all that is necessary to allow the electrical equipment 105 to operate normally after the surge arrester 110 has failed. Disconnecting the surge arrester 110 by melting the surge durable fuse element 120 does not require motion of any major parts of the surge arrester 110, such as leads and varistors of the surge arrester 110, which, in turn, reduces the clearance required around the major parts of the surge arrester 110, prevents moving parts from interfering with other parts of the electrical system 100, and maintains the mechanical strength of the surge arrester 110. The arcs created in the surge arrester 110 are also of a lesser energy than arcs created in conventional surge arresters as a result of the decreased arcing distance between the separated ends of the surge durable fuse element 120. Using the surge durable fuse element 120 reduces the number of other components needed in the surge arrester 110, and thereby reduces the cost of the surge arrester 110.

A number of implementations have been described. Nevertheless, it will be understood that various modifications may be made. Accordingly, other implementations are within the scope of the following claims.

What is claimed is:

1. A fault-tolerant protection device for protecting electrical equipment, the fault-tolerant protection device comprising:

a surge arrester connected in parallel to electrical equipment that has an impedance higher than an impedance of the electrical equipment at normal operating voltages and an impedance lower than an impedance of the electrical equipment at abnormally high voltages;

a surge durable fuse element connected in series with the surge arrester, the surge durable fuse element being configured to melt and separate when exposed to excessive power frequency current flowing through the surge arrester; and arc shortening tabs coupled to the surge durable fuse element and forming a gap that is shorter than a distance between ends of the surge durable fuse element;

wherein the surge durable fuse element and the surge arrester are immersed within a tank that is filled with fluid and that houses the electrical equipment, and the surge durable fuse element melts after approximately one cycle of exposure to an approximately 1250 Amp power frequency current.

2. The fault-tolerant protection device of claim 1 wherein:

the surge arrester is connected in series with the surge durable fuse element; and the series combination of the surge arrester and the surge durable fuse element is connected in parallel with the electrical equipment.

3. The fault-tolerant protection device of claim 1 wherein the surge arrester includes a module assembly that has an impedance higher than an impedance of the electrical equipment at normal operating voltages and an impedance lower than an impedance of the electrical equipment at abnormally high voltages.

4. The fault-tolerant protection device of claim 3 wherein the module assembly includes one or more metal oxide varistor disks.

5. The fault-tolerant protection device of claim 3 wherein the module assembly includes one or more spark gap assemblies.

6. The fault-tolerant protection device of claim 3 wherein the module assembly includes one or more electrically conductive spacer elements.

7. The fault-tolerant protection device of claim 1 wherein the electrical equipment is a transformer.

8. The fault-tolerant protection device of claim 1 wherein the surge arrester and the surge durable fuse element are internally incorporated in the electrical equipment.

9. The fault-tolerant protection device of claim 8 wherein the electrical equipment is filled with an insulating fluid.

10. The fault-tolerant protection device of claim 9 wherein the insulating fluid is a mineral oil.

11. The fault-tolerant protection device of claim 9 wherein the insulating fluid is a vegetable-based oil.

12. The fault-tolerant protection device of claim 1 further comprising a support for the surge durable fuse element.

13. The fault-tolerant protection device of claim 12 wherein the support includes the arc-shortening tabs.

14. The fault-tolerant protection device of claim 1, wherein the surge arrester includes a module assembly.

15. The fault-tolerant protection device of claim 14, wherein the module assembly includes at least one resistive element.

16. The fault-tolerant protection device of claim 15, wherein the at least one resistive element comprises one or more metal oxide varistor (MOV) disks.

17. The fault-tolerant protection device of claim 15, wherein the at least one resistive element comprises one or more varistors.

18. The fault-tolerant protection device of claim 15, wherein the at least one resistive element is reinforced with a composite.

19. The fault-tolerant protection device of claim 18, wherein the composite is wrapped around the at least one resistive element.

20. The fault-tolerant protection device of claim 18, wherein the composite comprises a fiber matrix.

21. The fault-tolerant protection device of claim 20, wherein the fiber matrix is impregnated with resin.

22. The fault-tolerant protection device of claim 20, wherein the fiber matrix is pre-impregnated with resin.

23. The fault-tolerant protection device of claim 20, wherein the fiber matrix is arranged around the at least one resistive element.

24. The fault-tolerant protection device of claim 20, wherein the fiber matrix contacts the at least one resistive element.

25. The fault-tolerant protection device of claim 14, wherein the module assembly includes at least one resistive element and a composite arranged around the at least one resistive element such that the module assembly forms a solid dielectric that is impervious to moisture ingress.

26. The fault-tolerant protection device of claim 25, wherein the at least one resistive element comprises at least one varistor.

27. The fault-tolerant protection device of claim 25, wherein the at least one resistive element comprises at least one MOV disk.

28. The fault-tolerant protection device of claim 25, wherein the composite is configured to fracture under pressure caused by failure of the surge arrestor to vent gas built up from the failure such that the at least one resistive element and the module assembly are not fragmented from the surge arrester by the failure.

29. The fault-tolerant protection device of claim 20, wherein the fiber matrix includes an open space that is filled with resin.

30. The fault-tolerant protection device of claim 20, wherein the fiber matrix includes open spaces, each of which are occupied by resin.

31. The fault-tolerant protection device of claim 29, wherein pressure due to failure of the module assembly fractures the resin that occupies the open space to vent gas through the open space.

32. The fault-tolerant protection device of claim 23, wherein the fiber matrix is fabricated prior to being arranged around the at least one varistor.

33. The fault-tolerant protection device of claim 20, wherein the fiber matrix comprises fiber bundles.

34. The fault-tolerant protection device of claim 33, wherein the fiber bundles are oriented in a random orientation.

35. The fault-tolerant protection device of claim 33, wherein the fiber bundles comprise fiberglass.

36. The fault-tolerant protection device of claim 33, wherein the fiber bundles comprise a non-conductive material.

37. The fault-tolerant protection device of claim 22, wherein the fiber matrix pre-impregnated with resin comprises at least 50% epoxy resin by weight.

38. The fault-tolerant protection device of claim 18, wherein the at least one resistive element is reinforced with the composite by applying the composite around the at least one resistive element multiple times.

39. The fault-tolerant protection device of claim 18, wherein the at least one resistive element is reinforced with the composite by applying the composite vertically to the at least one resistive element.

40. The fault-tolerant protection device of claim 18, wherein the at least one resistive element is reinforced with the composite by applying the composite circumferentially to the at least one resistive element.

41. The fault-tolerant protection device of claim 18, wherein the composite has a predetermined thickness.

42. The fault-tolerant protection device of claim 15, wherein the resistive element is reinforced by being wrapped in an impregnated composite, the impregnated composite comprising a fabricated matrix of fiber bundles arranged around the resistive element, the fabricated matrix defining open spaces having an epoxy resin occupying the open spaces in the fabricated matrix such that pressure caused by failure of the module assembly is able to fracture the epoxy resin to enable venting of gases through the open spaces.

43. The fault-tolerant protection device of claim 42, wherein the at least one resistive element comprises a varistor.

44. The fault-tolerant protection device of claim 42, wherein the at least one resistive element comprises a MOV disk.

* * * * *

UNITED STATES PATENT AND TRADEMARK OFFICE

CERTIFICATE OF CORRECTION

PATENT NO. : 7,633,737 B2
APPLICATION NO. : 10/834388
DATED : December 15, 2009
INVENTOR(S) : Ramarge et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 267 days.

Signed and Sealed this

Ninth Day of November, 2010

David J. Kappos

David J. Kappos
*Director of the United States Patent and Trademark Office*